US005457885A

United States Patent [19]

Ohashi et al.

[11] Patent Number: 5,457,885

[45] Date of Patent: Oct. 17, 1995

[54] HEAT EXCHANGER AND METHOD FOR PRODUCING THE SAME

[75] Inventors: Fumio Ohashi, Toyota; Norimasa Nishina, Toyohashi; Sunao Fukuda, Handa, all of Japan

[73] Assignee: Nippondenso Co., Ltd, Kariya, Japan

[21] Appl. No.: 299,019

[22] Filed: Aug. 31, 1994

[30] Foreign Application Priority Data

Sep. 1, 1993 [JP] Japan ..... 5-217785
Jul. 11, 1994 [JP] Japan ..... 6-158958

[51] Int. Cl.[6] ..... F28F 9/16; B21D 53/02

[52] U.S. Cl. ..... 29/890.044; 165/153; 165/173

[58] Field of Search ..... 29/890.044; 165/153, 165/173

[56] References Cited

U.S. PATENT DOCUMENTS 3,972,371 8/1976 Piegat .
4,700,469 10/1987 Kroetsch et al. .
4,730,669 3/1988 Beasley et al. ..... 165/173 X
4,813,112 3/1989 Pilliez .
5,314,021 5/1994 Potier et al. ..... 165/173 X

FOREIGN PATENT DOCUMENTS 2320866 11/1973 Germany .
59-180295 10/1984 Japan .

*Primary Examiner*—John C. Fox
*Attorney, Agent, or Firm*—Cushman, Darby & Cushman

[57] ABSTRACT

A pair of header plates securely brazed with a pair of side plates without causing any buckling to tubes and any deformation to the header plates. First, each tube is press-fitted into a corresponding press-fitting hole in the header plates, and at the same time, the end parts of a pair of side plates make contact with the pair of header plates. Second, flaring pins are press fitted into the end parts of the tubes in such a way that the end parts of the tubes disposed near either side of a core assembly are flared to an angle of approximately 180° and the end parts of the tubes disposed in the central part of the core assembly are flared to an angle within a range from approximately 60° to approximately 80°. Third, cores, etc. are hung from either of the upper header plates, whichever is disposed at the upper side, and then this assembly is brazed. At this time, large widening parts with an angle of approximately 180° can prevent the upper header plate from sliding downwards.

17 Claims, 8 Drawing Sheets

HEAT EXCHANGER AND METHOD FOR PRODUCING THE SAME

BACKGROUND OF THE INVENTION

1. Field of the Invention

The present invention generally relates to a method for producing a heat exchanger and to the heat exchanger produced by the method. More particularly, the present invention relates to a stack type heat exchanger that is brazed when a header plate disposed at an upper side is supported by jigs and cores and to the method for producing the stack type heat exchanger.

2. Related Art

As illustrated in FIGS. 5 and 6, it is known to stack cores 103 with a plurality of tubes 101 in order to form engine cooling water passages. Furthermore, it is known to assemble a plurality of corrugated fins 102 and connect a pair of header plates 104 to both ends of tubes 101, and also to connect header plates 104 using side plates 105. Cores 103 are hung from an upper header plate 104 in a downward direction. Upper header plate 104 is supported by carbon jigs 106. An assembly including these structure is integrally brazed within a furnace. Each tube 101 is lightly press fitted into each press-fitting hole 107 within the pair of header plates 104. Cores 103 are held between side plates 105 at both sides of the heat exchanger (in some cases, cores 103 are held between side plates 105 and bundled with wires, etc.).

When the assembly is brazed in this state, the brazing material clad on the surface of each tube 101 melts and flows, whereby the width in the direction of the stack of corrugated fins 102 and tubes 101 (lateral direction) is reduced, and at the same time, the reaction force of the corrugated fins 102, side plates 105, etc. is decreased in the high temperature condition associated with brazing. As a result, as illustrated in FIG. 7, a gap t1 is formed between the back of end side 105*a* of side plate 105 and the back of inner wall 108*a* of U-shape groove 108 formed on the distal end part of header plate 104.

Furthermore, when the brazing material clad on the surface of each tube 101 melts and flows, the diameter of each tube 101 is reduced, and at the same time, due to the exposure to high temperatures, the press-fitting force of each tube 101 press fits into each press-fitting hole 107 in the header plate 104 is decreased, whereby cores 103 hung from the upper header plate 104 may slide down by due to their own weight. If core 103 slides down from upper header plate 104, side plates 105 also slide down with cores 103. As illustrated in FIG. 7, a gap t2 forms between outermost part 105*b* of side plate 105 and the back of opposite surface 104*a* of header plate 104.

If the occurrence of at least one of the above gaps t1 and t2 can be prevented, side plates 105 and header plates 104 may be brazed to each other. If both gaps t1 and t2 occur, defects will be caused such that side plates 105 and header plates 104 are not brazed to each other, thus impairing the strength of the resulting heat exchanger.

Methods have been suggested to prevent cores 103, etc. hung from upper header plate 104 from sliding down due to their own weight. One possible alternative has been to flare the open end of each tube 101 (in other words, to widen the opening and increase the diameter thereof) press fit into each press-fitting hole 107 in header plate 104.

Such a technique has been proposed in Japanese Unexamined Patent Publication No. 59-180295. According to this document, tube flaring pins are inserted into the open ends of each tube 101 press fitted into each press-fitting hole 107 in header plates 104, and the end parts of each tube 101 are flared to an angle within a range from 20° to 30° to improve the connection force between each press-fitting hole 107 and the end parts of each tube 101.

During the brazing process, as core 103 is hung from upper header plate 104 through each tube 101 press fitted into each press-fitting hole 107 in header plate 104, as illustrated in FIG. 8, a force indicated by arrows A is applied to flared part of tube 101. This force (arrow A) is the resultant force made up of a vertical force (arrow B) and a horizontal force (arrow C). On the other hand, each tube 101 is softened during the brazing process due to the high brazing temperature. As a result, the flared angle of the flared part of the tube 101 is narrowed by the vertical force applied to the flared part of tube 101 (arrow B).

If the flared angle of the flared part of the tube 101 is narrowed during the brazing process in this way, the core 103 hung from the upper header plate 104 will slide down due to its weight, whereby, as illustrated in FIG. 7, the gap t2 is formed between the outermost part 105*b* of the side plate 105 and the opposite surface 104*a* of the header plate 104.

Another method has been disclosed in U.S. Pat. No. 4,700,469. According to this Patent, the end parts of each tube 101 press fitted into the press-fitting holes 107 in the header plates 104 are flared to an angle of approximately 180°. If the flared angle is set to approximately 180° in this way, any horizontal force will not cause part of the tube 101 to widen, even if the core 103 is hung from the upper header plate 104 through each tube 101. Accordingly, the widened angle of widening part of each tube 101 will not be narrowed during the brazing process, whereby the core 103 hung from the upper header plate 104 will not slide down due to its own weight. As a result, the gap t2 is not formed between the outermost part 105*b* of the side plate 105 and the opposite surface 104*a* of the header plate 104.

When the end parts of the tubes 101 are flared to an angle of approximately 180°, considerably large loads are applied to the tube 101 and to the header plate 104 supporting the tubes 101. According to the disclosure of U.S. Pat. No. 4,700,469, the end parts of all the tubes 101 are flared to an angle of approximately 180°. Therefore, if the end parts of all the tubes 101 are flared to such an angle, considerably large loads had to be applied to all the tubes 101 and the header plate 104 around the respective tubes 101.

The loads applied to the end parts of the header plate 104 are supported by the side plates 105, which have a sufficiently high strength to support the load, and the tubes 101, which do not have a sufficiently high strength. However, loads applied to the central area of the assembly of cores 103 are supported only by the tubes 101, which is not desirable.

For this reason, if the technique disclosed in the U.S. Pat. No. 4,700,469 is applied, considerably large loads will be applied to the tubes 101 disposed in the central area of the assembly of the cores 103. As a result, defects are caused such as the buckling of the tubes 101 disposed in the central area of the assembly of the cores 103 and warp deformation of the upper header plate 104.

SUMMARY OF THE INVENTION

In view of the above problem, it is an object of the present invention to provide a method for producing a heat exchanger which allows the header plates and the side plates to be securely brazed without any buckling of the tubes or deformation of the header plates and to provide a heat exchanger produced by this producing method.

The present invention includes a method for producing a heat exchanger having cores stacked with a plurality of tubes having first and second end parts provided with engine cooling water passages therein and a plurality of corrugated fins, a pair of header plates including a plurality of press-fitting holes, and a pair of side plates disposed at sides of the cores for connecting the pair of header plates to each other in a state where the cores are held therebetween. The method includes press fitting the first and second end parts of the plurality of tubes into the press-fitting holes in the pair of header plates. The method further includes contacting end parts of the pair of side plates with the pair of head plates, thus forming a heat exchanger assembly. Also, the method includes flaring at least one of the first and second end parts of the tubes to be disposed on an upper side during blazing, wherein tubes disposed in a central parts of the header plate are flared to have a smaller degree than those tubes disposed proximate the side plates, thus preventing the tubes from sliding during blazing. Finally the method includes brazing the assembly within a furnace.

This method produces a heat exchanger comprising a plurality of cores stacked with a plurality of tubes, each tube having first and second end parts, provided with engine cooling water passages therein and a plurality of corrugated fins zigzaggedly formed, a pair of header plates including a plurality of press-fitting holes into which the end parts of the plurality of tubes are press fitted and connected, and a pair of side plates disposed at sides of the plurality of cores for connecting the pair of header plates to each other in the state that the cores are held therebetween, wherein at least one end of the plurality of tubes to be press fitted into the press-fitting holes in the header plates is flared, and the flared angles of the end parts of the tubes disposed proximate the side plates is set to be larger than the flared angle of the end parts of the tubes disposed in a central part of the assembly of the cores.

According to the method for producing a heat exchanger according to the present invention, a pair of header plates and a pair of side plates can be securely brazed without complicating the shapes of the components of the heat exchanger, such as header plates and side plates, by setting the flare angle of the end parts of the tubes disposed in the side plate areas to be larger than the flare angle of the end parts of the tubes disposed in the central part of the core assembly.

In addition, as the flare angle of the end parts of the tubes disposed in the central part of the core assembly is set to be smaller than the flare angle of the end parts of the tubes disposed in the side plate areas, loads applied to the tubes disposed in the central part of the core assembly can be minimized. As a result, the buckling of the tubes disposed in the central part of the core assembly or the deformation of the header plate can be prevented, whereby the pair of header plates and the pair of side plates can be securely brazed.

If the tubes are made thinner, the press fitting force of each tube press fitted into each press-fitting hole and the hardness of the tubes during the brazing process is further reduced. Accordingly, the a defect that the core, etc. hung from the upper header plate slides down due to its own weight during the brazing process can easily occur. By adopting the method according to the present invention, however, even if the tubes are made thinner, the sliding downward of the tubes disposed in the side plate areas during the brazing process is prevented, whereby the pair of header plates and the pair of side plates can be securely brazed.

BRIEF DESCRIPTION OF THE DRAWINGS

Other objects, features and characteristics of the present invention as well as the function of related parts will become apparent upon a study of the following detailed description, the appended claims and the drawings, all of which form a part of this specification. In the drawings:

DETAILED DESCRIPTION OF THE PRESENTLY PREFERRED EXEMPLARY EMBODIMENTS

The method for producing a heat exchanger according to the present invention will be described based on the first embodiment referring to FIGS. 1, 2 and 3.

Figure 1:
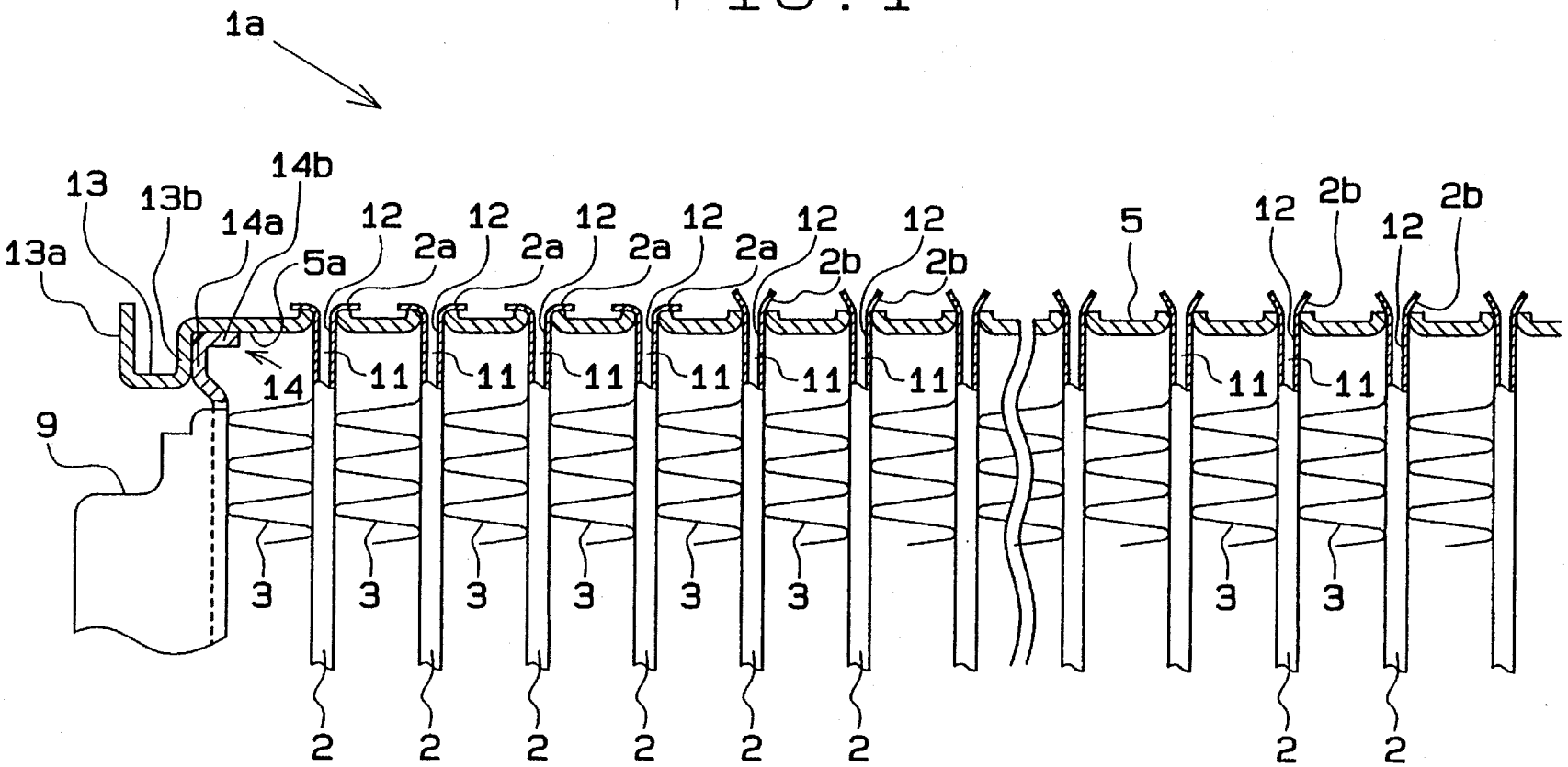
FIG. 1 is a cross-sectional view illustrating the main part of a radiator according to a first embodiment.
Figure 2:
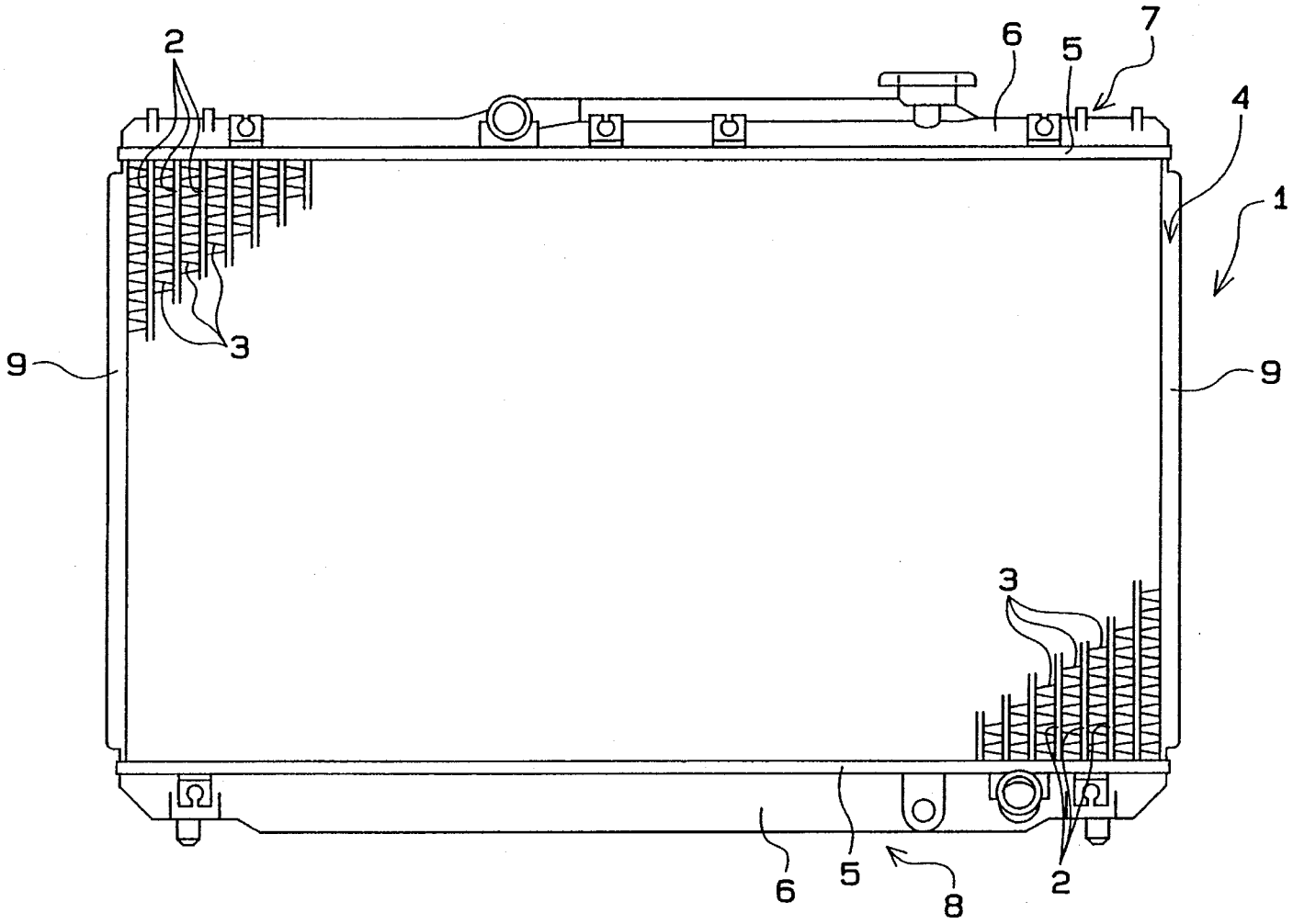
FIG. 2 is a front view illustrating the radiator.
Figure 3:
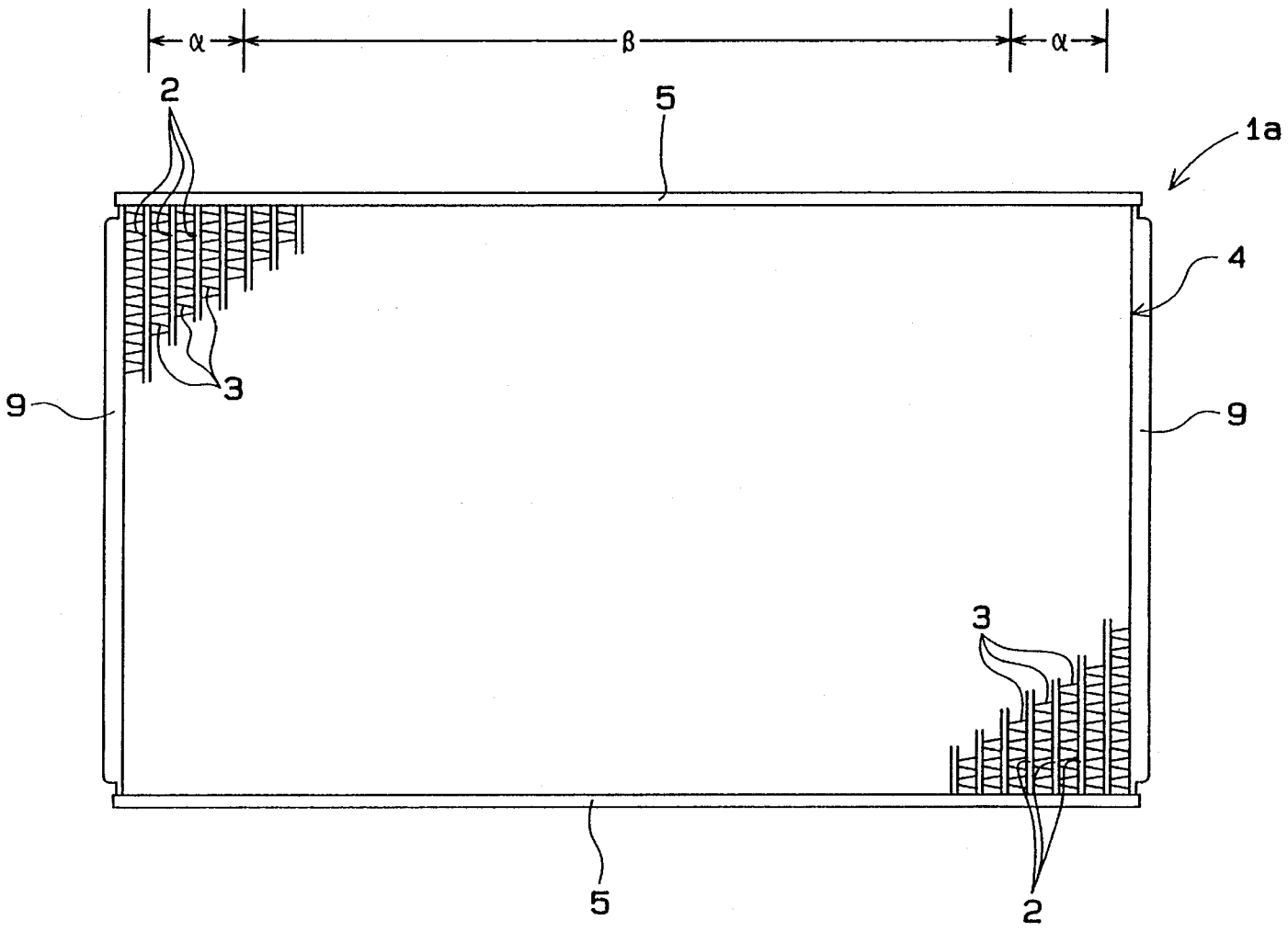
FIG. 3 is a front view illustrating a core.

FIGS. 1, 2 and 3 illustrate the first embodiment of the present invention. FIG. 1 is a cross-sectional view illustrating the main part of a radiator, FIG. 2 is a front view illustrating the radiator, and FIG. 3 is a front view of a core assembly.

Radiator 1, for cooling engine cooling water, is referred to as an example of a heat exchanger. The radiator 1 comprises a core assembly 4 including a plurality of tubes 2 and a plurality of corrugated fins 3 both of which are alternately stacked, a pair of header plates 5 connected to the plurality of tubes 2 at respective ends thereof, an inlet tank 7 and an outlet tank 8 both of which include header tanks 6 fixed to the header plates 5 respectively, and a pair of side plates 9 disposed on both sides of the core assembly 4 for connecting the pair of header plates 5 to each other at the ends thereof. The components of the radiator 1 except for the header tanks 6, i.e., the core assembly 4 (including the tubes 2 and the corrugated fins 3), the header plates 5 and the side plates 9, are made of aluminum, which are integrally brazed in a furnace into the main body of the radiator 1. The header tanks 6 are made of resin, and are fixed to the header plates 5 of the brazed main body of the radiator 1 through packings (not illustrated).

The tube 2 is made of a thin aluminum plate which is rolled and then seamed by means of welding into a tube having a crushed and elliptical cross section. The inside of the tube 2 forms a fluid passage 11 that allows the engine cooling water to flow therethrough. The surface of the tube 2 is clad with a brazing material.

The corrugated fin 3 is made of a thin aluminum plate strip zigzaggedly formed by means of rolling. The air-flow part of the corrugated fin 3 is equipped with louvres (not illustrated) for higher heat exchange efficiency.

The header plate 5 is made of an aluminum plate which is pressed into the required shape and then clad with a brazing material on one side thereof, the side which interfaces with the external surface of the header tank 6. The header plate 5 includes a plurality of press-fitting holes 12 into which the plurality of tubes 2 are press fitted. The header plate 5 has U-shaped grooves 13 at both distal end parts into which the end parts of the header tank 6 are inserted. The press-fitting holes 12 of this embodiment are formed to be open into the header tank 6 by a burring process. The outer wall 13*a* of the groove 13 is provided with a number of claws (not illustrated), which are intended to be folded after an open end of the header tank 6 is inserted into the groove 13 so that the header tank 6 can be fixed to the header plate 5.

The side plate 9 is made of an aluminum plate which is pressed to have a U-shape cross section and then clad with a brazing material, at least on the side to which the corrugated fin 3 is to be connected. In addition, the end parts of the side plate 9 are provided with connecting parts 14, respectively which are pressed into a rough U-shape. The back part 14*a* of the connecting part 14 is to be connected to the back part of the inner wall 13*b* of the groove 13 of the header plate 5, and the outermost wall 14*b* of the connecting part 14 is to be connected to the opposite surface 5*a* of the header plate 5 facing the inner surface of the other header plate 5.

Of all the tubes 2 press fitted into the header plate 5, those tubes 2 disposed near either side of the header plates 5, which account for approximately 10% of the tubes, i.e. the tubes 2 near side plates 9 as indicated by α in FIG. 3, are provided at the ends with large widened parts 2*a*, which have been flared to an angle of approximately 180° by large flaring pins (not illustrated). On the other hand, those tubes 2 disposed in the central part of the core assembly 4 and accounting for approximately 80% of all the tubes 2, i.e. those tubes 2 indicated by β in FIG. 3, are provided at the ends with small widening parts 2*b*, which have been flared to only an angle within a range from approximately 60° to about 80° by flaring pins (not illustrated) smaller than those which operated upon the flaring pins in the range α. The respective outer peripheries of the large widening parts 2*a* and small widening parts 2*b* fit the respective press-fitting holes 12. Now, the pair of the side plates 9 are in contact at the ends with the pair of header plates 5 with the large widening parts 2*a* and the small widening parts 2*b* formed integrally therewith. In this state, the main part of the radiator 1 is brazed. Although the tubes 2 disposed near either side of the side plates 9 accounting for approximately 10% of the total tubes are flared to an angle of approximately 180°, the percentage of the tubes 2 that are flared to an angle of approximately 180° may be changed to an adequate percentage according to the weight of the core assembly 4, etc.

The manufacturing processes of the above radiator 1 will now be described.

First, the plurality of tubes 2 and the plurality of corrugated fins 3 are alternately stacked, and then side plates 9 are disposed at both sides thereof. Second, the pair of header plates 5 are disposed at the end parts of the plurality of tubes 2, then the end parts of all the tubes 2 are press fitted into the respective press-fitting holes 12 in the header plates 5. Then the connecting parts 14 at the end parts of the pair of side plates 9 are contacted to the pair of header plates 5 (first process).

The main body part l*a* (FIG. 1) assembled in the first process (an assembly of the plurality of tubes 2, the plurality of corrugated fins 3, the pair of header plates 5 and the pair of side plates 9 illustrated in FIG. 3) is set into a tube widening device (not illustrated). The tube widening device press fits large flaring pins having an angle of approximately 180° into the engine cooling water passages 11 of the tubes 2 disposed near either of the side plates 9 and accounting for approximately 10% of all the tubes 2. Smaller flaring pins, having an angle within a range from approximately 60° to about 80° into the engine cooling water passages 11 of the remaining about 80% of the tubes 2 disposed in the central area of the core assembly 4 indicated by β in FIG. 3. As a result, the large widening parts 2*a* with a flare angle of approximately 180° are formed on the end parts of approximately 10% of the tubes 2 disposed near either end of the core assembly 4, and the small widening parts 2*b* with a flare angle within a range from approximately 60° to approximately 80° are formed on the end parts of approximately 80% of the tubes 2 disposed in the central area of the core assembly 4 (second process).

A description of the tube end widening device used in the second process is now provided. The tube end widening device has disposed on its upper and lower sides the large flaring pins to be press fitted into the engine cooling water passages 11 at the end parts of approximately 10% of the tubes 2 disposed near either of the side plates 9 to widen the end parts of the above tubes 2 to an angle of 180° and the smaller flaring pins to be press fitted into the engine cooling water passages 11 at the end parts of approximately 80% of the tubes 2 disposed in the central part of the core assembly 4 to widen the end parts of the above tubes 2 to an angle within a range from 60° to 80°. The large flaring pins and the small flaring pins, which are designed to widen the end parts of the tubes 2 to make the flared outer peripheries of the tubes 2 match the respective press fitting holes 12, comprise tip guiding parts to be inserted into the engine cooling water passages 11 to prevent the engine cooling water passages 11 from being narrowed during the widening process and widening parts for widening the end parts of the tubes 2 towards both sides. Between the large flaring pins and the small flaring pins are disposed spacers so that the intervals therebetween match the interval between the tubes 2.

In addition, the tube end widening device is equipped with an upper supporter at the upper side for supporting the large flaring pins and the small flaring pins and a lower supporter at the lower side for supporting the larger flaring pins and the small flaring pins. At least one of the upper supporter and lower supporter is so provided as to be driven up/down by a driving means. Between the large and small flaring pins at the upper side and those at the lower side is placed the main body part la assembled in the first process. Then, either of the upper supporter or the lower supporter is driven by a predetermined amount for a driving stroke, and then subjected to a predetermined amount of load. By this process, the large widening parts 2*a* are formed at the end parts of approximately 10% of the tubes 2 disposed near either side of the core assembly 4 and the small widening parts 2*b* are formed at the end parts of approximately 80% of the tubes 2 disposed in the central part of the core assembly 4.

Here, the tube end widening device is equipped with a clamp for supporting the core assembly 4 from both sides of the pair of side plates 9 during the widening process. This clamp is applied to both sides of the core assembly 4 to protect the tubes 2 disposed near either side of the core assembly 4 and the pair of side plates 9 from deformation.

In this embodiment, the large widening parts 2*a* and the small widening parts 2b are formed at the end parts of all the tubes 2 in the second process. This arrangement prevents the header plates 5 at both sides from moving outwards. In addition, between the header plates 5 at both sides are disposed the pair of side plates 9 in contact with the above header plates 5. This arrangement can prevent the header plates 5 at both sides from moving inward. That is, even if some loads are applied to the main body part la from the outside, the assembled state achieved in the first process can be maintained.

Figure 6:
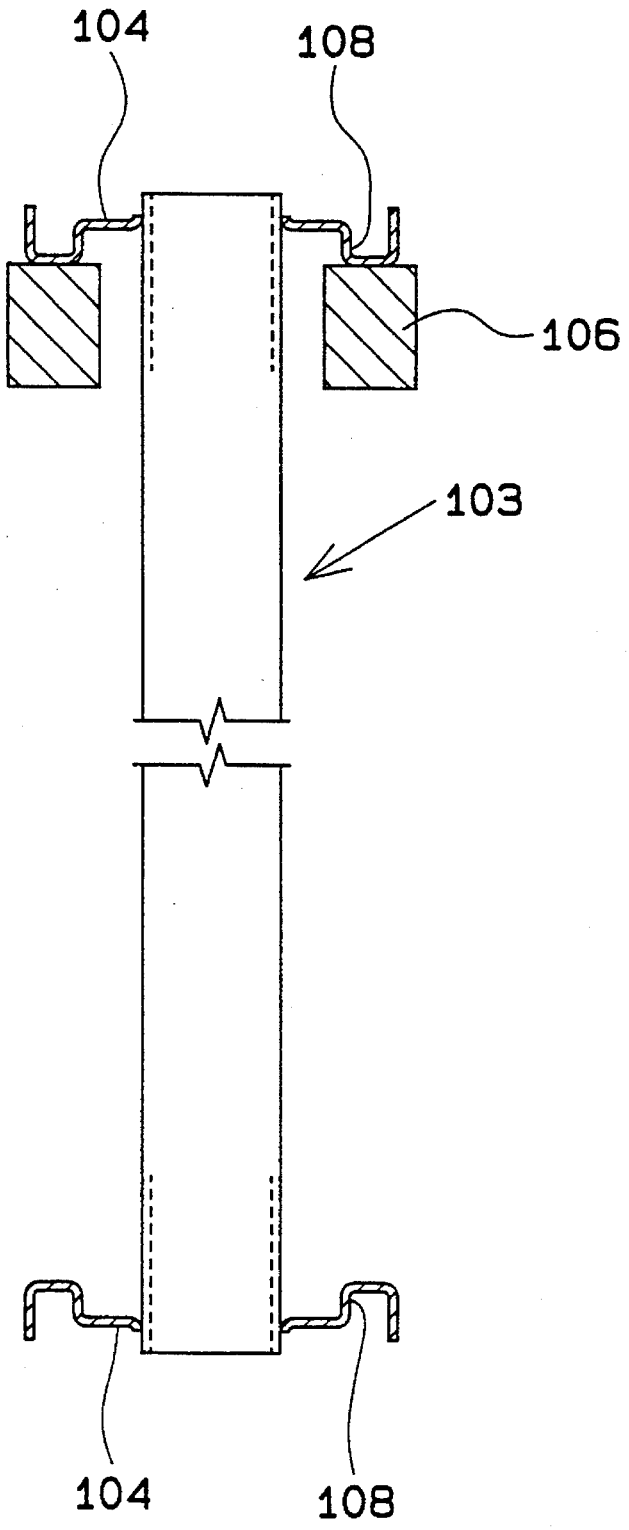
FIG. 6 is a cross-sectional side view illustrating a heat exchanger during brazing process of a known structure.
Figure 7:
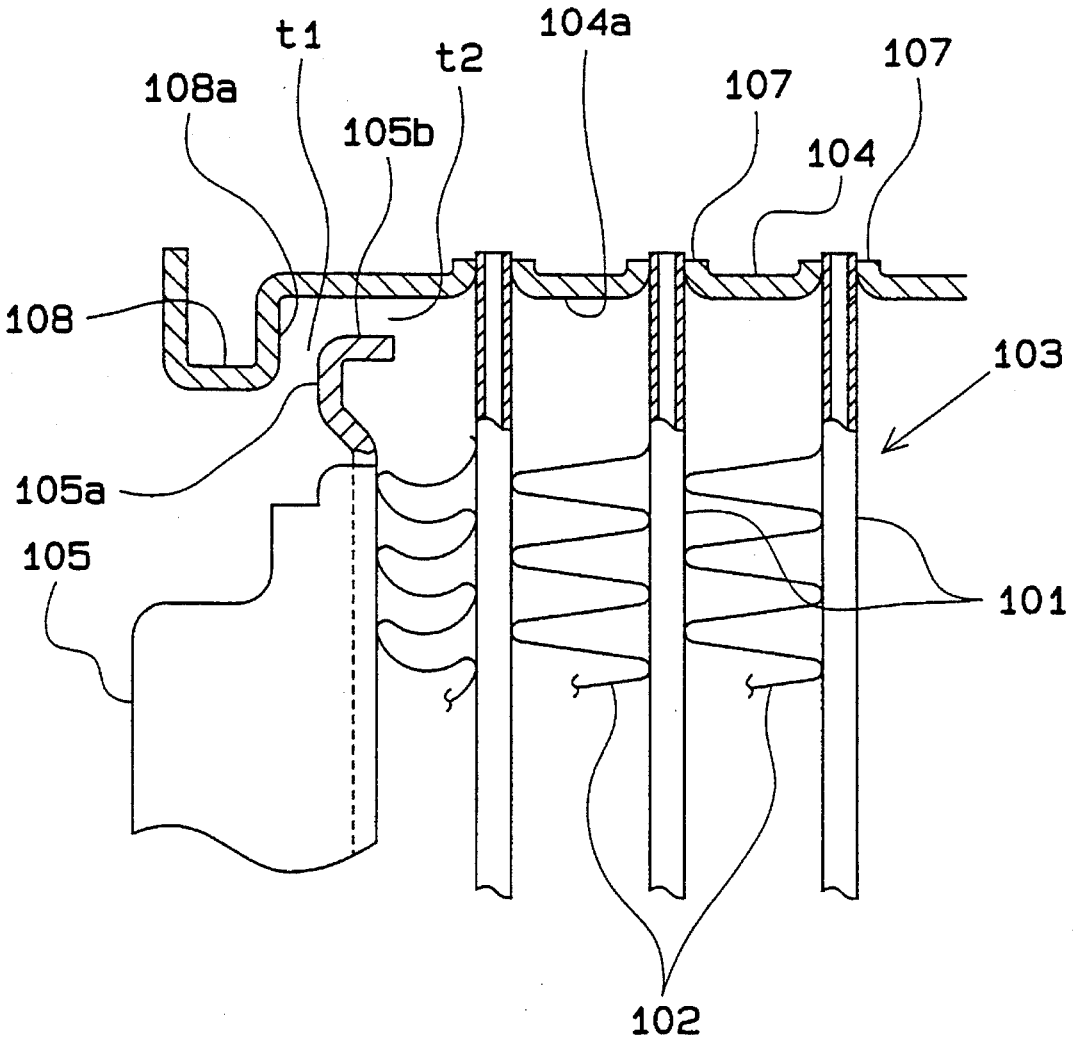
FIG. 7 is an illustrative view illustrates a defective part of a heat exchanger of a known structure.
Figure 8:
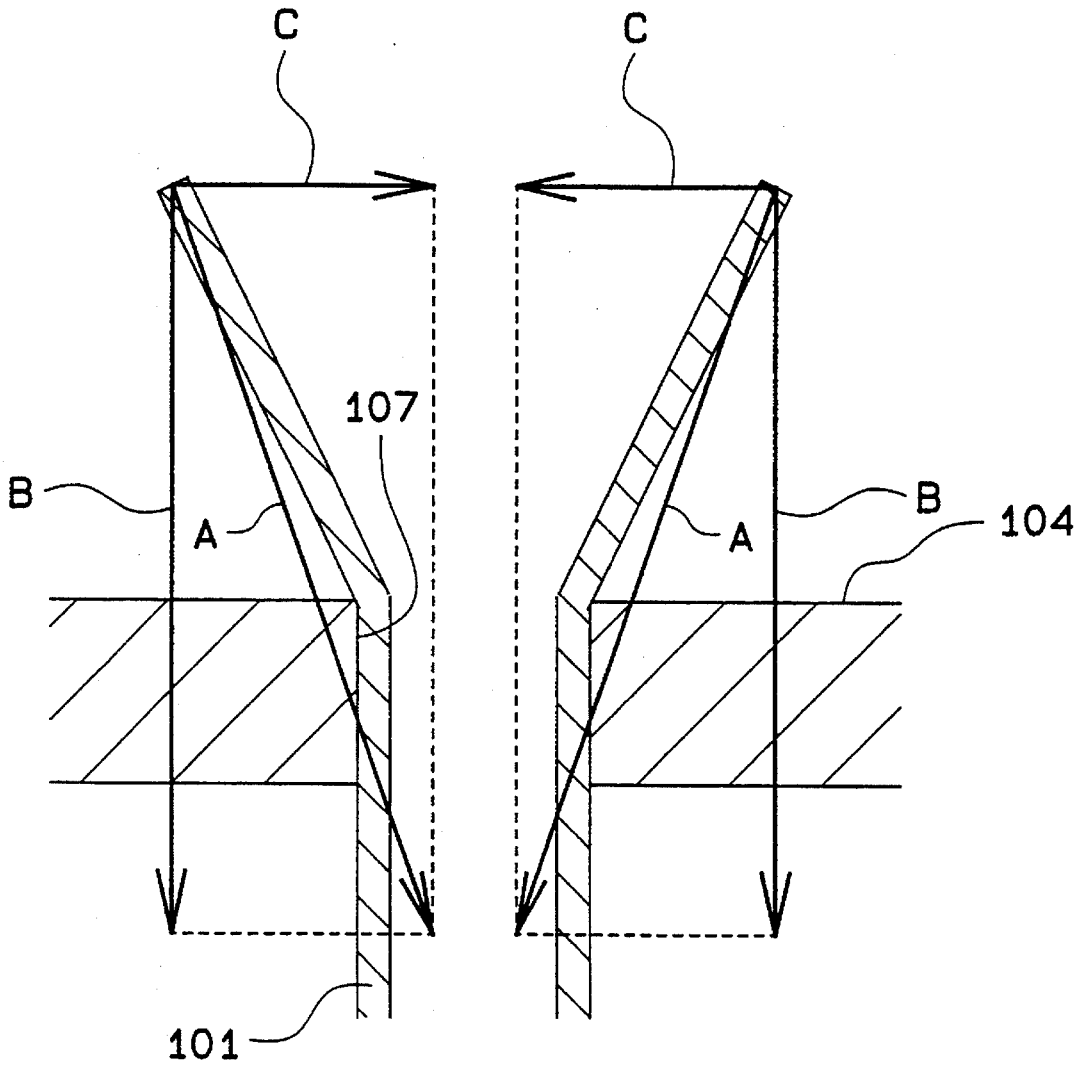
FIG. 8 is an illustrative view illustrating the occurrence of a defect of the heat exchanger in a known structure.

Only one of the header plates 5 is supported by carbon jigs, such as those described with reference to FIG. 6 (refer to the jigs 106 described), and the core assembly 4, etc. are hung from the header plate 5 supported by the jigs. The assembled main body part la arranged in the above state is then placed into a furnace and heated to a temperature high enough to melt the brazing material thereon to integrally braze the main body part 1a (brazing process). In this embodiment, as the end parts of the tubes 2 are flared, the header plate 5 to be supported by the jigs may be either of the header plate 5 forming the inlet tank 7 or the header plate 5 forming the outlet tank 8.

When the main body part la is exposed to a high temperature in the furnace, the brazing material clad on each component thereof melts. Then, the melted brazing material spreads to the contacting part of each component, forming a brazing core.

On the other hand, when the main body part 1a is exposed to a high temperature in the furnace, due to the lowering of the hardness of the tubes 2, the power of the press-fitting holes 12 to hold the tubes 2 decreases to such an extent that only the holding power of the press-fitting holes 12 can not resist the downward force due to the self-weight of the core assembly 4. However, as the upper end of approximately 10% of the tubes 2 disposed near either side of the core assembly 4 are flared to an angle approximately 180°, even if the hardness of the tubes 2 is lowered, the flared angle will not be narrowed by the self-weight of the core assembly 4. This arrangement can protect the tubes 2 disposed near either side of the core assembly 4 from slipping down from the upper header plate 5. As a result, the contacting state of the contacting parts 14 at the end parts of the side plates 9 disposed on both sides of the core assembly 4 with the pair of header plate 5 is maintained, whereby the pair of header plates 5 and the pair of side plates 9 are exactly be brazed.

[Effect of the Embodiment]

As mentioned above, without complicating the shape of the components of the radiator 1 including the header plates 5 and the side plates 9, the pair of header plates 5 and the pair of side plates 9 can exactly be brazed and thereby the degradation in the strength of the radiator 1 can exactly be prevented by widening the end parts of approximately 10% of the tubes 2 disposed near either side of the core assembly 4 to an angle of approximately 180°, which is larger than the flared angle within a range from approximately 60° to 80° applied to the end parts of approximately 80% of the tubes 2 disposed in the central part of the core assembly 4.

On the other hand, as the end parts of approximately 80% of the tubes 2 displaced in the central part of the core assembly 4 are flared to an angle within an range from approximately 60° to 80°, which is smaller than the flared angle for the tubes 2 disposed near either side of the side plates 9, only small loads are required for widening approximately 80% of the tubes 2 disposed in the central part of the core assembly 4. As a result, the buckling of the tubes 2 disposed in the central part of the core assembly 4 or the deformation of the header plates 5 can be prevented.

As only the end parts of the tubes 2 are flared and the tubes 2 are not flared within the press-fitting holes 12, only small loads are required for widening the end parts of the tubes 2. That is, if the tubes 2 should be flared within the press-fitting holes 12, as larger loads will have to be applied to the tubes 2, defects such as the buckling of the tubes 2 would be caused. In this embodiment, however, as any application of large loads is not required to the tubes 2, any buckling of the tubes 2 will not be caused.

By widening the end parts of the tubes 2, either one of the pair of header plates 5 can be supported by the carbon jig. This arrangement facilitates the handling of the main body part 1a during the manufacturing processes.

Also, by widening the end parts of the tubes 2, the state of assembling achieved in the first process can be maintained, even if some loads are applied from the outside to the main body part 1a. This arrangement also facilitates the handling of the main body part la during the manufacturing processes.

Furthermore, by widening the end parts of the tubes 2, even if the main body part 1a is exposed to a high temperature within a furnace, the header plate 5 disposed at the lower side will not come off from the tubes 2. This arrangement can prevent the occurrence of the defective brazing at the lower side.

Figure 4:
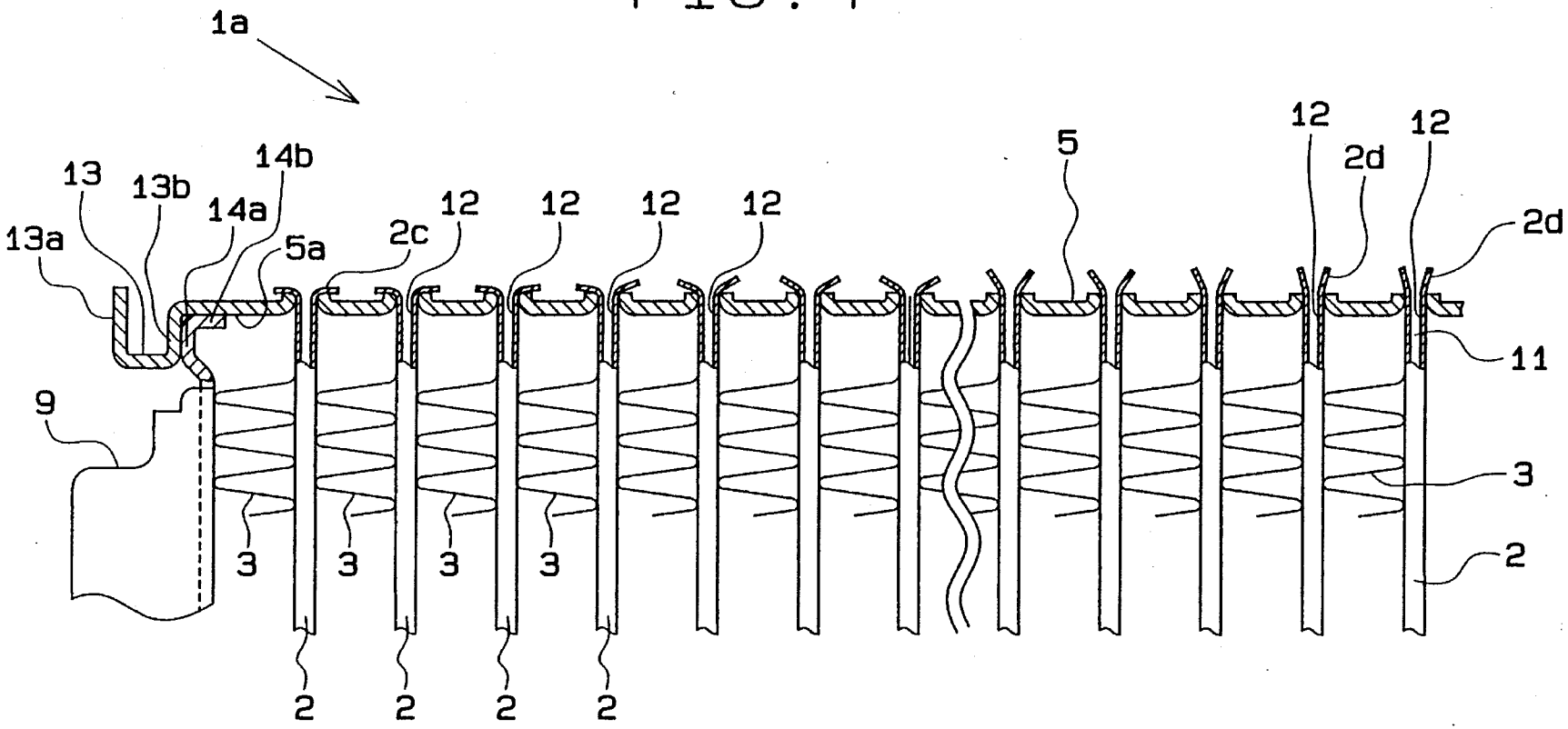
FIG. 4 is a cross-sectional view illustrating the main part of a radiator according to a second embodiment.
Figure 5:
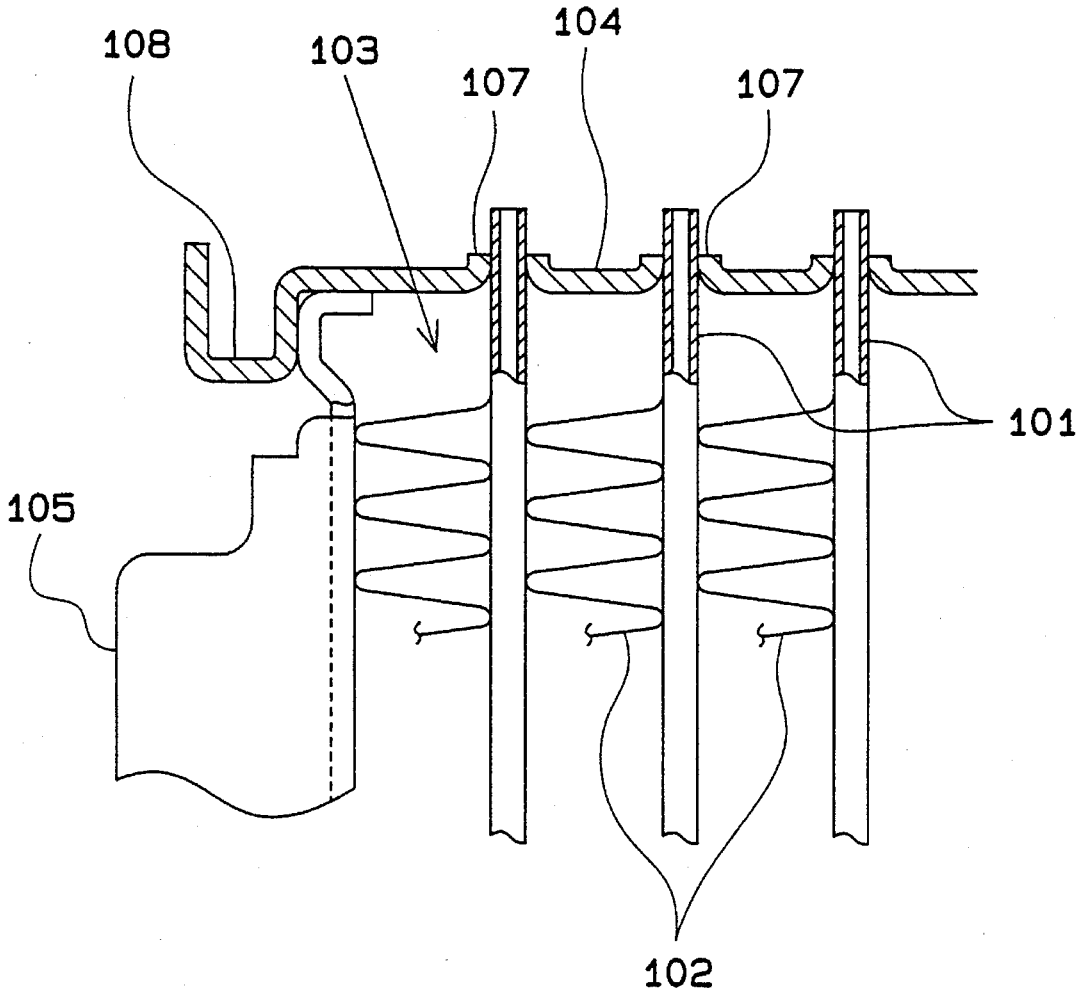
FIG. 5 is a cross-sectional view illustrating the main part of a heat exchanger of a known structure.

FIG. 4 depicts a cross-sectional view illustrating the main part of the radiator 1 according to the second embodiment of the present invention.

In the above first embodiment, a case was presented where the flared angle of approximately 10% of the tubes 2 disposed near either side of the core assembly 4 is set to an angle approximately 180° and the flared angle of remaining approximately 80% of the tubes 2 disposed in the central part of the core assembly 4 is set to an angle within a range from approximately 60° to approximately 80°. In this embodiment, however, as illustrated in FIG. 4, the flared angles of the end parts of the tubes 2 gradually decrease in the size of the angle as the tubes progress from the sides near the side plate 9 towards the center of the core assembly 4. That is, the widening parts 2c of the tubes 2 near either side of the side plate 9 are flared to the largest angle of approximately 180°, while the widening parts 2d of the tubes 2 in the central part of the core assembly 4 are flared to the smallest angle of approximately 0°.

In the above embodiments, the case was presented where the end parts of the tubes 2 disposed near either side of the core assembly 4 are flared to larger angles, while the end parts of the tubes 2 disposed in the central part of the core assembly 4 are flared to smaller angles. However, it is acceptable that the tubes 2 with large flared angles and the tubes 2 with small flared angles are alternately disposed every one or more than one tubes 2 or randomly disposed. Alternatively, it is also acceptable that more than three different flared angles are set and the tubes 2 with these three different flared angles respectively are alternately disposed every one or more than one tubes 2 or continuously or even randomly disposed.

Also, a case was presented where the press-fitting holes 12 of the header plates 5 are formed to be open into the header tank 6 by a burring process, it is acceptable that the press-fitting holes 12 are formed into mere through holes.

Also, although a case was presented where both end parts of each tube 2 are flared, it is acceptable that only one of the end parts of the tubes 2, to be brazed to the upper header plate 5, are flared.

Furthermore, although the radiator 1 is used as an example of a heat exchanger, any type of heat exchanger in which tubes and corrugated fins are alternately stacked, such as exchanger with heater cores or refrigerating cycles, may be used instead.

Moreover, although the case has been described above where the header tanks 6 are made of a resin, it is acceptable that the tank headers 6 are made of a metal and integrally brazed with other components including the cores 3.

What is claimed is:

1. A method for producing a heat exchanger having cores stacked with a plurality of tubes having first and second end parts provided with engine cooling water passages therein and a plurality of corrugated fins, a pair of header plates including a plurality of press-fitting holes, and a pair of side plates disposed at sides of said cores for connecting said pair of header plates to each other in a state where said cores are held therebetween, said method comprising the steps of:

press fitting said first and second end parts of said plurality of tubes into said press-fitting holes in said pair of header plates;

contacting end parts of said pair of side plates with said pair of head plates, thus forming a heat exchanger assembly;

flaring at least one of said first and second end parts to be disposed on an upper side during brazing, wherein tubes disposed in a central parts of said header plate are flared to have a smaller degree than those tubes disposed proximate said side plates, thus preventing said tubes from sliding during brazing brazing said assembly within a furnace.

2. The method for producing a heat exchanger according to claim 1, further comprising the step of between said flaring step and said brazing step, supporting one of said header plates with jigs in such a manner so as to hang down an assembly consisting of said cores, said pair of header plates and said side plates.

3. The method for producing a heat exchanger according to claim 1, wherein said flaring step includes flaring said plurality of tubes such that tubes disposed in a central part have a flared angle that gradually increases as the tubes become closer to said side plates.

4. The method for producing a heat exchanger according to claim 3, further comprising the step of between said flaring step and said brazing step, supporting one of said header plates with jigs in such a manner so as to hang down an assembly consisting of said cores, said pair of header plates and said side plates.

5. The method for producing a heat exchanger according to claim 1, wherein said flaring step includes flaring the tubes in the central part such that a mean value of the flared angles of the end parts is smaller than a mean value of the flared angles of the end parts of the tubes disposed proximate said side plates.

6. The method for producing a heat exchanger according to claim 1, further comprising the step of providing at least one tube proximate said side plates, before said press-fitting step, said at least one tube having a flared angle greater than a mean value of the flared angles of said tubes disposed in said central part.

7. The method for producing a heat exchanger according to claim 1, further comprising the step of providing at least one tube in said central part, before said press-fitting step, said at least one tube having a flared angle smaller than a mean value of the flared angles of the tubes disposed proximate said side plates.

8. The method for producing a heat exchanger according to claim 1, wherein said flaring step includes flaring said end parts of said tubes disposed in said central part such that they have a flared angle between about 60° to about 80°.

9. The method for producing a heat exchanger according to claim 8, wherein said flaring step includes flaring said end parts of the tubes disposed in proximate said side plate such that they have a flared angle of approximately 180°.

10. The method for producing a heat exchanger according to claim 1, further comprising the step of providing side plate areas proximate said side plate such that each side plate area contains approximately 10% of all the tubes and the tubes disposed in said central part account for approximately 80% of all the tubes.

11. A method for producing a heat exchanger having cores stacked with a plurality of tubes having first and second end parts provided with engine cooling water passages therein and a plurality of corrugated fins, a pair of header plates including a plurality of press-fitting holes, and a pair of side plates disposed at both sides of said cores for connecting said pair of header plates to each other in the state where said cores are held therebetween, said method comprising the steps of:

press fitting said first and second end parts of said plurality of tubes into said press-fitting holes in said pair of header plates;

contacting end parts of said pair of side plates with said pair of head plates, thus forming a heat exchanger assembly;

flaring at least one of said first and second end parts of said tubes to be disposed on an upper side during brazing, wherein tubes disposed in a first group have a larger flared angle than tubes to disposed in a second group, said first and second groups preventing said tubes from sliding down from said header plate;

brazing said assembly within a furnace.

12. The method for producing a heat exchanger according to claim 11, comprising the step of inserting flaring pins into said tubes to be set at an upper side during brazing.

13. The method for producing a heat exchanger according to claim 11, wherein said flaring step includes providing said first group proximate each said side plate and said second group at a central area of the assembly of said cores.

14. The method for producing a heat exchanger according to claim 13, wherein said flaring step includes providing tubes in said first group accounting for approximately 20% of all the tubes and said providing tubes in said second group accounting for approximately 80% of all the tubes.

15. The method for producing a heat exchanger according to claim 11, wherein said flaring step includes flaring the end parts of said first group such that said tubes have a flared angle of approximately 180° and the end parts of said second group such that said tubes have flared angles within a range from about 60° to about 80°.

16. A heat exchanger comprising:

a plurality of cores stacked with a plurality of tubes, each tube having first and second end parts, provided with engine cooling water passages therein and a plurality of corrugated fins zigzaggedly formed;

a pair of header plates including a plurality of press-fitting holes into which said end parts of said plurality of tubes are press fitted and connected; and a pair of side plates disposed at sides of said plurality of cores for connecting said pair of header plates to each other in the state that said cores are held therebetween;

wherein at least one end of said plurality of tubes to be press fitted into the press-fitting holes in the header plates is flared, and the flared angles of the end parts of the tubes disposed proximate said side plates is set to be larger than the flared angle of the end parts of the tubes disposed in a central part of the assembly of said cores.

17. A method for forming a stacked type heat exchanger to be brazed, comprising the steps of:

providing header plates having a plurality of press-fitting holes;

providing a plurality of tubes having end parts;

press-fitting said end parts of said tubes into said press-fitting holes; and flaring said end parts disposed in a central area of said plurality of tubes, said tubes in said center area being flared to an angle smaller than an angle to which tubes disposed surrounding said central area are flared.

* * * * *